US012345131B2

(12) United States Patent
Phillips et al.

(10) Patent No.: US 12,345,131 B2
(45) Date of Patent: Jul. 1, 2025

(54) DOWNHOLE ROTARY DRIVE APPARATUS

(71) Applicant: STEEL SPACE CASING DRILLING LTD, Berwick (GB)

(72) Inventors: Alan Phillips, Lauder (GB); Tomasz Jozef Walerianczyk, Lauder (GB); Matias Garza, Lauder (GB)

(73) Assignee: STEEL SPACE CASING DRILLING LTD, Berwick (GB)

( * ) Notice: Subject to any disclaimer, the term of this patent is extended or adjusted under 35 U.S.C. 154(b) by 0 days.

(21) Appl. No.: 18/285,235

(22) PCT Filed: Mar. 31, 2022

(86) PCT No.: PCT/GB2022/050813
§ 371 (c)(1),
(2) Date: Sep. 29, 2023

(87) PCT Pub. No.: WO2022/208095
PCT Pub. Date: Oct. 6, 2022

(65) Prior Publication Data

US 2024/0183223 A1 Jun. 6, 2024

(30) Foreign Application Priority Data

Apr. 1, 2021 (GB) ..... 2104767

(51) Int. Cl.
*E21B 4/00* (2006.01)
*E21B 4/02* (2006.01)

(52) U.S. Cl.
CPC ..... *E21B 4/006* (2013.01); *E21B 4/02* (2013.01)

(58) Field of Classification Search
CPC ... E21B 4/006; E21B 4/02; E21B 4/00; E21B 4/16
See application file for complete search history.

(56) References Cited

U.S. PATENT DOCUMENTS 4,314,615 A * 2/1982 Sodder, Jr. ..... E21B 4/16 175/94
2011/0100715 A1* 5/2011 Kolle ..... E21B 21/16 475/71

(Continued)

FOREIGN PATENT DOCUMENTS

WO WO-92/19835 A1 11/1992

OTHER PUBLICATIONS

International Search Report and Written Opinion on PCT App. PCT/GB2022/050813 dated Jun. 28, 2022 (12 pages).

*Primary Examiner* — Yanick A Akaragwe
(74) *Attorney, Agent, or Firm* — Foley & Lardner LLP

(57) ABSTRACT

A downhole rotary drive apparatus (10) for driving a bit (12) used to drill or ream a borehole (B) comprises a body (14) configured for coupling to, or forming part of, a tubular string (S1;S2;S3) for running into the borehole (B) and an output shaft (16) at least partially disposed within and rotatably mounted to the body (14). A plurality of rotary drives (32) are disposed around the body (14), each having a rotor (36). The apparatus (10) further comprises a transmission arrangement (46) comprising a drive component mounted on at least one of the rotors (36) of the rotary drives (32) and a driven component mounted on the output shaft (16). The driven component is disposed radially inwards of the drive component such that an inner surface of the drive component engages an outer surface of the driven component, rotation of the driven component by the drive component driving rotation of the output shaft (16). The rotary drives (32) and/or the transmission arrangement (46) of the rotary drive apparatus (10) are disposed within blade portions disposed on or formed in the body (14).

23 Claims, 5 Drawing Sheets

(56) References Cited

U.S. PATENT DOCUMENTS

| | | | | |
|---|---|---|---|---|
| 2012/0201659 | A1 | 8/2012 | Savage et al. | |
| 2014/0170011 | A1* | 6/2014 | Clouzeau | E21B 43/121 418/201.1 |
| 2020/0232281 | A1 | 7/2020 | Phillips | |
| 2021/0277748 | A1* | 9/2021 | Rajagopalan | E21B 47/12 |

* cited by examiner

DOWNHOLE ROTARY DRIVE APPARATUS

CROSS-REFERENCE TO RELATED APPLICATIONS

This application is a U.S. National Phase Application under 35 U.S.C. § 371 of International Application No. PCT/GB2022/050813, filed on Mar. 31, 2022, which claims the benefit of and priority to GB Appl. No. 2104767.5 filed Apr. 1, 2021, each of which is incorporated herein by reference in their entirety for any and all purposes.

FIELD

This relates to a downhole rotary drive apparatus, a downhole tool comprising the rotary drive apparatus, a downhole system comprising the downhole tool and a method for drilling or reaming a borehole.

BACKGROUND

In the oil and/or gas industry, in order to extract hydrocarbons from a hydrocarbon bearing formation a well borehole is drilled from surface. Traditionally, boreholes would be drilled using a drill string constructed from connected sections of drill pipe having a drill bit at the distal end of the string. Once a section of the borehole had been drilled, the drill string would be removed and the borehole section lined with sections of metal bore-lining tubing known as casing, which are also typically run into the borehole in the form of a bore-lining tubing string. The annulus between the bore-lining tubing string and the borehole would then be filled with cement, which supports the borehole and seals the annulus to prevent uncontrolled flow of hydrocarbons to surface.

More recently, casing drilling technologies have been developed in which the bore-lining tubing string, e.g. casing string or liner string, is used to drill the borehole. Casing drilling offers advantages over traditional drill string technologies in terms of time and thus cost savings for an operator.

In order to rotate the drill bit, casing drilling typically involves rotating the casing string from surface using the top drive. However, this method may have numerous limitations. For example, the torque limits of the casing connections are often reached before the desired depth is reached. Complex drilling assemblies that deliver power to the drill bit downhole have been developed. However, these assemblies are recovered to surface once the well is drilled to the desired depth. This is time consuming and current products are both expensive and unreliable.

SUMMARY

Aspects of the present disclosure relate to a downhole rotary drive apparatus, a downhole tool comprising the rotary drive apparatus, a downhole system comprising the downhole tool, and a method for drilling or reaming a bore.

According to a first aspect, there is provided a downhole rotary drive apparatus for driving a bit used to drill or ream a borehole, the apparatus comprising:

- a body configured for coupling to, or forming part of, a tubular string for running into the borehole, wherein the body comprises one or more radially-projecting blade portions;
- an output shaft at least partially disposed within and rotatably mounted to the body, wherein the output shaft is configured for coupling to the bit such that rotation of the output shaft relative to the body drives rotation of the bit;
- a plurality of rotary drives disposed around the body, wherein each of the plurality of rotary drives comprises a respective rotor; and
- a transmission arrangement for converting rotation of the rotors of the rotary drives into rotation of the output shaft, wherein the transmission arrangement comprises a drive component mounted on at least one of the drive shafts of the plurality of rotary drives and a driven component mounted on the output shaft, the driven component being disposed radially inwards of the drive component such that an inner surface of the drive component engages an outer surface of the driven component so that rotation of the driven component by the drive components drives rotation of the output shaft,
- and wherein at least part of the rotary drives and/or part of the transmission arrangement are disposed within the blade portions.

In use, the apparatus is configured to be run into the borehole, e.g. oil and/or gas wellbore, on the tubular string and operable to drive the bit to drill or ream the borehole.

Beneficially, the apparatus facilitates the driving of the bit and thus drilling or reaming of the borehole with greater efficiency and in a shorter time span than conventional systems. The apparatus is particularly beneficial in deviated, high angle and/or horizontal boreholes which typically suffer from limitations such as the torque limits of casing connections being reached before the desired depth is reached.

In use, the blade portions may act as stabilisers offsetting the body from the borehole while permitting fluid flow in the annulus between the outside of the body and the borehole. Amongst other things, this may facilitate circulation of drive fluid (e.g. drilling mud) through the rotary drive apparatus and back to surface and/or transportation of drill cuttings from the bit to surface.

Locating the rotary drives and/or the transmission arrangement within the blade portions provides a number of significant benefits. For example, locating the rotary drives and/or the transmission arrangement within the blade portions acts to protect the rotary drives and/or the transmission arrangement from damage, e.g. from drill cuttings in the annulus and/or abrasive particulate matter entrained within fluid in the annulus. Moreover, locating the rotary drives and/or the transmission arrangement within the blade portions permits the rotary drives and the transmission arrangement to be located at a greater radial distance from a central longitudinal axis of the apparatus. Locating the rotary drives and/or the transmission arrangement within the blade portions also permits the rotary drives and the transmission arrangement to be located at a greater radial distance from a central longitudinal axis of the apparatus, and thus generate more power to drive the bit.

As described above, the apparatus comprises a body configured for coupling to, or forming part of, a tubular string for running into the borehole.

The body may form a stator of the rotary drive apparatus.

The body may be tubular.

The body may comprise a section of casing or liner.

The body may comprise a throughbore disposed therethrough.

The body may comprise a unitary construction. The body may be modular in construction. The body may comprise a mandrel portion. The body may comprise an outer housing.

The body may comprise a top sub. The top sub may comprise a connection arrangement for coupling the rotary drive apparatus to the tubular string for running the apparatus into the borehole. The connection arrangement may take the form of a threaded connection, such as a threaded box or pin connection. However, it will be understood that the connection arrangement make take any suitable form.

As described above, the body comprises radially-projecting blade portions. It will be understood that the term blade portion means a centralising or stabilisation member.

The blade portions may be integrally formed with the mandrel portion of the body. Alternatively, the blade portions may be configured for coupling to the mandrel portion of the body.

The apparatus may comprise one or more slots ("junk slots"). The one or more slots may be arranged to facilitate evacuation of drilling or reaming debris between the blade portions.

As described above, at least part of the rotary drives may be disposed within the blade portions. The rotary drives may be wholly disposed within, e.g. radially positioned within, the blade portions. Alternatively, part of the rotary drives may be disposed within, e.g. radially positioned within, the blade portions. Part of the rotary drives may be disposed, e.g. radially positioned within, a mandrel portion of the body.

As described above, part of the transmission arrangement may be disposed within, e.g. radially positioned within, the blade portions. For example, the driven component may be partially disposed, e.g. radially positioned within, the blade portions.

As described above, the apparatus comprises a tubular shaft at least partially disposed within and rotatably mounted to the body, wherein the shaft is configured for coupling to the bit such that rotation of the shaft relative to the body drives rotation of the bit so as to drill or ream the borehole.

The output shaft may be tubular.

The output shaft may comprise or take the form of a section of drill pipe. The output shaft may comprise or take the form of a pup joint. The bit may be coupled, e.g. welded, onto the output shaft.

The output shaft may comprise a throughbore disposed therethrough. The throughbore of the output shaft may be of the same or substantially similar diameter to the throughbore of the body. The throughbore of the body and the throughbore of the output shaft may be configured (e.g. sized and shaped) to permit passage of a subsequent, smaller, drill bit and thereby facilitate the drilling out of the bit without the requirement to drill through the rotary drive apparatus.

As described above, the apparatus comprises a plurality of rotary drives disposed around the body, wherein each of the plurality of rotary drives comprises a respective rotor.

One or more of the rotary drives may comprise or take the form of a motor.

One or more of the rotary drives may be fluid-powered.

One or more of the rotary drives may comprise or take the form of a positive displacement motor.

Alternatively, one or more of the rotary drives may comprise another suitable form of rotary drive.

One or more of rotary drives may be powered by pressure and/or flow of a drive fluid. The drive fluid may comprise drilling fluid, such as drilling mud. The apparatus may be configured so that the pressure and/or flow of the drilling fluid pumped through the apparatus causes the drive component mounted on the at least one rotor of the plurality of motors to drive the driven component mounted on the drill pipe.

The rotary drives may be circumferentially arranged and/or spaced.

One or more of the rotary drives may be attached to a wall of the body.

A maximum outer diameter of each of the plurality of rotary drives may be less than a maximum outer diameter of the body. For example, the diameter of each of the plurality of rotary drives may be 25% or less than that of the diameter of the body.

A majority portion of each of the rotary drives may be positioned significantly outwards of a central longitudinal axis of the apparatus in such a way that no portion of any of the rotary drives extends across the central longitudinal axis of the apparatus. Beneficially, the rotary drives may thus be disposed on the body such that there is an access passage through the apparatus. In use, the access passage permits unrestricted passage of a subsequent, smaller diameter, bit through the apparatus in order to drill out the bit and extend the borehole.

The apparatus may comprise any suitable number of rotary drives. For example, the apparatus may comprise between two and fifteen rotary drives.

As described above, each of the plurality of rotary drives comprises a respective rotor. The rotor may comprise or take the form of a drive shaft. The rotor may comprise or take the form of a helicoidal rotor.

Each of the rotary drives may comprise a stator. The stator may be integrally formed within the body. Alternatively, the stator may comprise a separate component coupled to the body. The stator may comprise or take the form of an elastomer-lined stator. Alternatively or additionally, the stator may be at least partially constructed from a metallic material. The stator and the rotor may form a rotor-stator assembly.

In use, the drive fluid, e.g. drilling fluid, may be directed to the rotary drives to drive rotation of the rotors relative to the stators. The hydraulic energy provided by the drive fluid, e.g. drilling fluid, may be utilised to rotate the rotor that in turn rotates the output shaft. In use, the rotary drives may thus provide torque to the bit.

For example where the rotary drive comprises or takes the form of a positive displacement motor, the rotor may turn eccentrically, i.e. follow an eccentric path, relative to the stator. Alternatively, the rotor may turn concentrically relative to the stator.

The apparatus may comprise or define a fluid conduit. In use, the fluid conduit may deliver drive fluid to the rotary drives, e.g. to drive rotation of the rotors relative to the stators. The fluid conduit may comprise an inlet. The inlet may be arranged to receive the drive fluid from the throughbore of the body. The fluid conduit may comprise an outlet. The outlet may be arranged to communicate the drive fluid from the fluid conduit to the annulus.

The apparatus may comprise a screen. The screen may act to filter the drive fluid before entering the inlet.

The apparatus may comprise a valve, such as a dump valve. The valve, e.g. dump valve, may be configured or arranged to receive the fluid, e.g. drilling fluid. The valve may allow drilling fluid circulation when the pressure is below a certain threshold.

The valve may take the form of the valve shown and described in International Patent Application No. PCT/GB2020/051712, the contents of which are incorporated by reference.

The rotary drives may be mounted on the body by any suitable means, e.g. by welding, soldering, adhesive bonding, and/or by mechanical fixings. At least one of the rotary drives may be encapsulated by portions of the body.

As described above, the apparatus comprises a transmission arrangement comprising a drive component mounted on at least one of the drive shafts of the plurality of fluid-powered rotary drives and a driven component mounted on the tubular shaft, the driven component disposed radially inwards of the drive component such that an inner surface of the drive component engages an outer surface of the driven component, whereby rotation of the driven component by the drive component drives rotation of the tubular shaft.

The transmission arrangement may comprise a drive component. The transmission arrangement may comprise a driven component. The drive component may be rotatably mounted on at least one drive shaft of the plurality of motors. The driven component may be rotatably mounted on the drill pipe. The driven component may be attached to the drill pipe.

In use, the driven component may be attached to the drill pipe, transmitting the torque to the drill pipe causing the rotation of the drill pipe and in turn rotation of the drill bit.

The transmission arrangement may comprise or take the form of a gear assembly.

Alternatively or additionally, the drive component and the driven component may engage via a high friction coating.

The apparatus may comprise a bearing arrangement. The bearing arrangement may be interposed between the body and the output shaft. The bearing arrangement may comprise one or more, and in particular a plurality of bearings. The bearing arrangement may comprise one or more rotary bearing. The bearing arrangement may comprise one or more thrust bearing.

The apparatus may comprise or may be operatively associated with a plug.

Beneficially, the plug may assist the rotary drives to power up.

The plug may be mounted or mountable internally on the body. The plug may be configured to divert the drilling fluid into the plurality of rotary drives.

The plug may take the form of the plug shown and described in International Patent Application No. PCT/GB2020/051712, the contents of which are incorporated herein by reference.

The plug may comprise or take the form of a packer, for example a drilling packer.

According to a second aspect, there is provided a downhole tool for drilling or reaming a borehole, the downhole tool comprising:

the apparatus of the first aspect; and a bit.

The bit may comprise or take the form of a drill bit.

Alternatively, the bit may comprise or take the form of a reaming bit suitable for reaming a pre-drilled borehole.

The bit may comprise or take the form of a drillable bit, e.g. a drillable drill bit or a drillable reaming bit. The bit may be formed to facilitate drill through by a further bit. For example, the bit or part of the bit may be formed from a readily drillable material.

The drill bit may comprise one or more cutters. The cutters may comprise or take the form of diamond cutters, polycrystalline diamond compact (PDC) cutters or other suitable cutters.

The drill bit may comprise one or more flow ports. The flow ports may comprise or take the form of nozzles. The nozzles may be formed in, or provided on, the cutters. The flow ports may assist the drive fluid to circulate back to surface via the annulus.

The drill bit may be configured for coupling to the output shaft.

According to a third aspect, there is provided a downhole assembly comprising:

the downhole tool of the second aspect; and a tubular string.

The tubular string may comprise or take the form of a bore-lining tubular string. For example, the tubular string may comprise or take the form of a casing string. The tubular string may comprise or take the form of a liner string.

The tubular string may comprise or take the form of a production tubing string.

According to a fourth aspect, there is provided a method for drilling a borehole using the downhole tool of the second aspect or the downhole system of the third aspect.

The method may comprise locating the bit on the rotary drive apparatus.

The method may comprise locating the rotary drive apparatus on the tubular string.

The method may comprise running the downhole tool into the borehole on the tubular string.

The method may comprise directing drive fluid, e.g. drilling mud, to and/or through the apparatus.

The invention is defined by the appended claims. However, for the purposes of the present disclosure it will be understood that any of the features defined above or described below may be utilised in isolation or in combination. For example, features described above in relation to one of the above aspects or below in relation to the detailed description below may be utilised in any other aspect, or together form a new aspect.

BRIEF DESCRIPTION OF THE DRAWINGS

These and other aspects will now be described with reference to the accompanying drawings, of which.

DETAILED DESCRIPTION OF THE DRAWINGS

Figure 1:
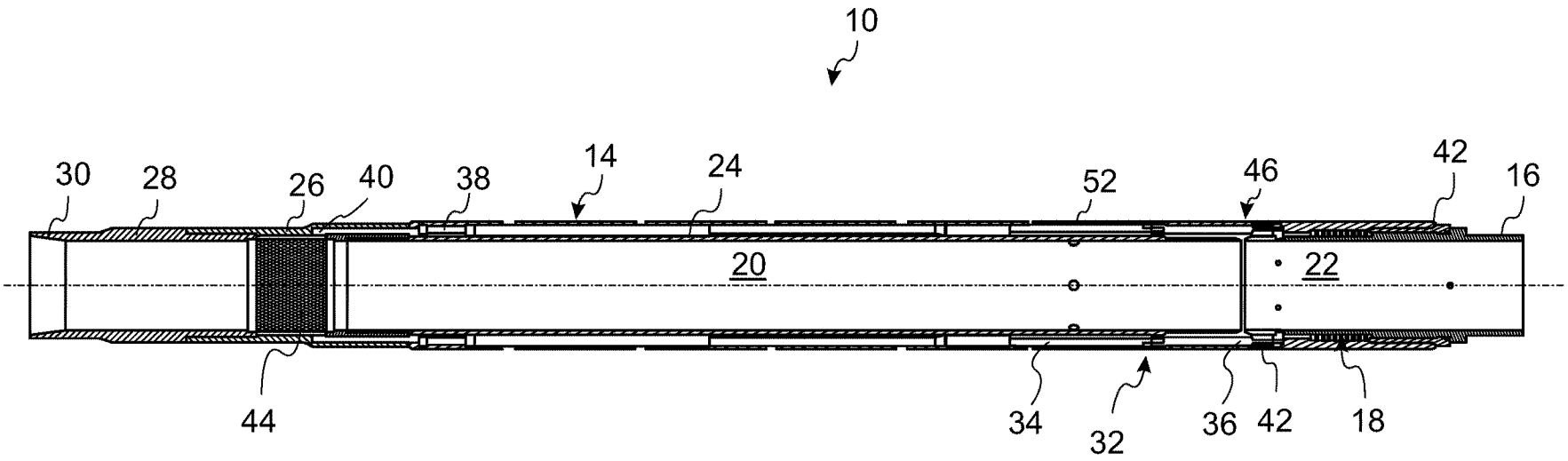
FIG. 1 shows a longitudinal sectional view of a rotary drive apparatus for driving a bit in order to drill or ream a borehole.
Figure 2:
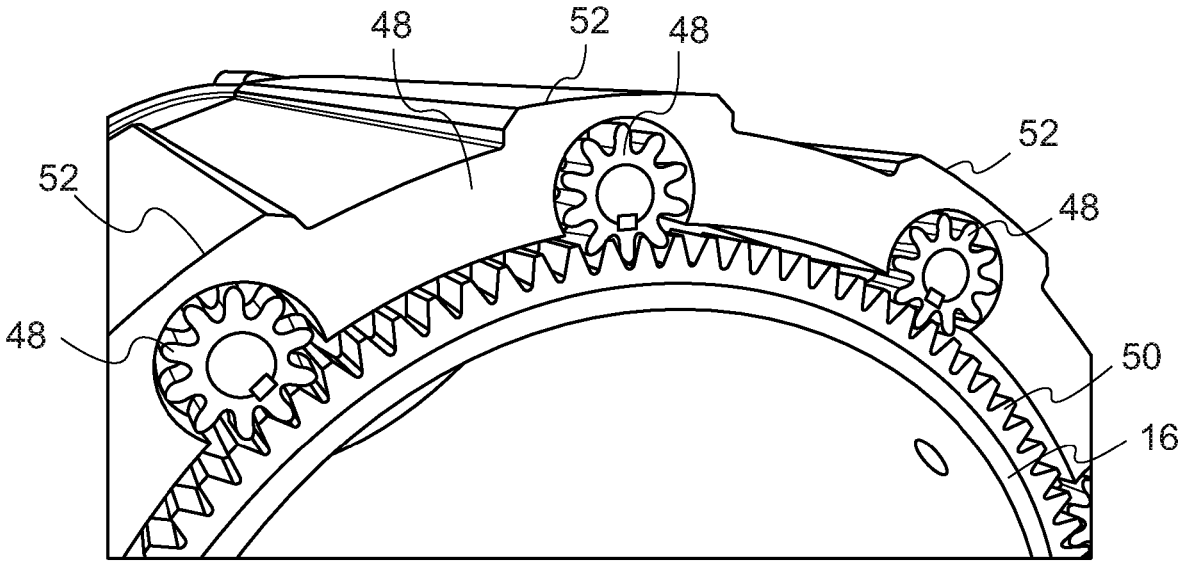
FIG. 2 shows an enlarged view of the part of the rotary drive apparatus shown in FIG. 1.

Referring first to FIGS. 1 and 2 of the accompanying drawings, there is shown show a rotary drive apparatus 10 for driving a bit 12 (shown in FIGS. 3 and 4) in order to drill or ream a borehole B.

As shown in FIG. 1, the apparatus 10 comprises a body 14 that defines a stator of the rotary drive apparatus 10 and an output shaft 16 that defines a rotor of the rotary drive apparatus 10.

The output shaft 16 is carried by and rotatably mounted to the body 14 via a bearing arrangement, generally denoted 18. As shown, the output shaft 16 is partially disposed within the body 14 such that a distal end portion of the output shaft 16 extends axially from the body 14. The output shaft 16 is configured for coupling to the bit 12 such that rotation of the output shaft 16 relative to the body 14 drives rotation of the bit 12 so as to drill or ream the borehole B.

The body 14 is tubular in construction, having a throughbore 20 disposed therethrough. The output shaft 16 is also tubular in construction, having a throughbore 22 disposed therethrough. The throughbore 22 is of the same or substantially similar diameter to the throughbore 20 of the body 14. In the illustrated apparatus 10, the throughbores 20, 22 are configured (e.g. sized and shaped) to permit passage of a subsequent, smaller, drill bit (not shown) and thereby facilitate the drilling out of the bit 12 without the requirement to drill through the rotary drive apparatus 10.

As shown in FIG. 1, in the illustrated apparatus 10 the body 14 is modular in construction, having a mandrel 24, and an outer housing 26. The body 14 further comprises a top sub 28 comprising a connection arrangement 30 for coupling the rotary drive apparatus 10 to a tubular string S for running the apparatus 10 into the borehole B. In the illustrated apparatus 10, the connection arrangement 30 takes the form of a threaded box connection. However, it will be understood that the connection arrangement 30 make take any suitable form.

The apparatus 10 further comprises a plurality of fluid-powered rotary drives 32 (two of the rotary drives 32 are shown in FIG. 1). As shown in FIG. 1, each rotary drive 32 takes the form of positive displacement motor having a stator 34 and a rotor 36 in the form of a drive shaft. In the illustrated apparatus 10, the stators 34 are separate components disposed within the apparatus 10. However, it will be understood that the stators 34 of the rotary drives 32 may alternatively be integrally formed by the body 14.

As shown in FIG. 1, a fluid conduit 38 is defined within the apparatus 10. In use, the fluid conduit 38 delivers drive fluid to the rotary drives 32 in order to drive rotation of the rotors 36 relative to the stators 34. The fluid conduit 38 has an inlet 40 that receives the drive fluid from the throughbore 20 and an outlet 42 that communicates the drive fluid from the fluid conduit 38 to the annulus A. In the illustrated apparatus 10, the apparatus 10 further comprises a screen 44 that acts to filter the drive fluid before entering the inlet 40.

As shown in FIG. 1, and referring in particular to FIG. 2, the apparatus 10 further comprises a transmission arrangement, generally denoted 46. In the illustrated apparatus 10, the transmission arrangement 46 comprises a drive mechanism in the form of drive gears 48 mounted on the rotors 36 of the rotary drives 32 and a driven mechanism in the form of a driven gear 50 mounted on the output shaft 16. As shown, the driven gear 50 is disposed radially inwards of the drive gears 48 such that an inner surface of the drive gears 48 engages (in the illustrated apparatus 10 meshes with) an outer surface of the driven gear 50, with rotation of the drive gears 48 by the rotary drives 32 driving rotation of the output shaft 16.

As shown most clearly in FIG. 2, the apparatus 10 further comprises a number of blade portions 52. In the illustrated apparatus 10, the blade portions 52 form an integral part of the body 14. However, it will be understood that one or more of the blade portions 52 may alternatively form a separate component coupled to an outer surface of the body 14.

As shown in FIG. 2, the blade portions 52 are circumferentially arranged and spaced. The blade portions 52 also extend axially along the length of the apparatus 10.

In use, the blade portions 22 acts as stabilisers offsetting the body 14 from the borehole B while permitting fluid flow in the annulus A (shown in FIG. 3) between the outside of the body 14 and the borehole B. Amongst other things, this facilitates circulation of drilling fluid (e.g. drilling mud) through the rotary drive apparatus 10 and back to surface and/or transportation of drill cuttings from the bit 12 to surface.

As shown most clearly in FIG. 2, the rotary drives 32 and the transmission arrangement 46 of the apparatus 10 are disposed within the blade portions 52.

This provides a number of significant benefits. For example, locating the rotary drives 32 and the transmission arrangement 46 within the blade portions 52 protects the rotary drives 32 and the transmission arrangement 46 from damage, e.g. from drill cuttings in the annulus A, abrasive particulate matter entrained within the fluid in the annulus A. Moreover, as noted above the apparatus 10 is configured to permit the bit 12 to be drilled out by a subsequent, smaller diameter, drill bit (not shown) and thereby facilitate the drilling out of the bit 12 without the requirement to drill through the rotary drive apparatus 10, more particularly the rotary drives 32, transmission arrangement 46 and bearing arrangement 18. Locating the rotary drives 32 and the transmission arrangement 46 within the blade portions 52 permits the rotary drives 32 and the transmission arrangement 46 to be located at a greater radial distance from a central longitudinal axis of the apparatus 10. Locating the rotary drives 32 and the transmission arrangement 46 within the blade portions 52 also permits the rotary drives 32 and the transmission arrangement 46 to be located at a greater radial distance from a central longitudinal axis of the apparatus 10, and thus generate more power to drive the bit.

Figure 3:
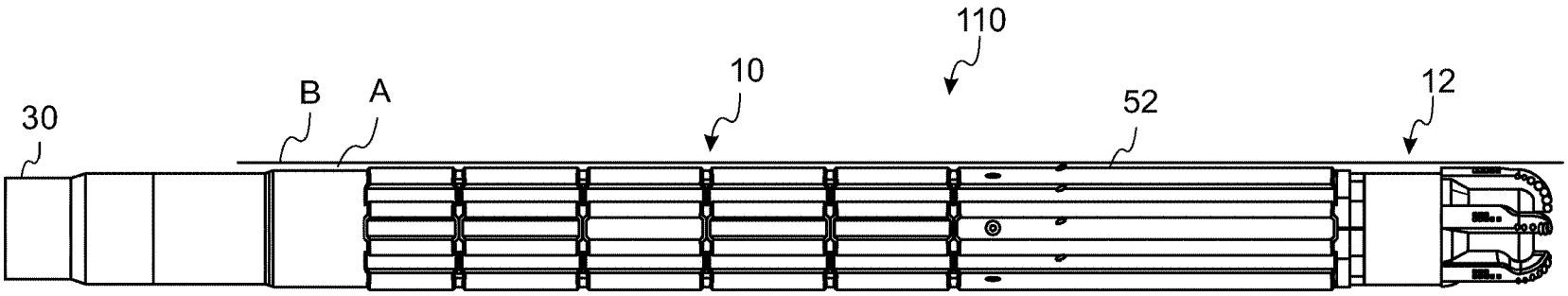
FIG. 3 shows a side view of a downhole tool comprising the rotary drive apparatus shown in FIG. 1.
Figure 4:
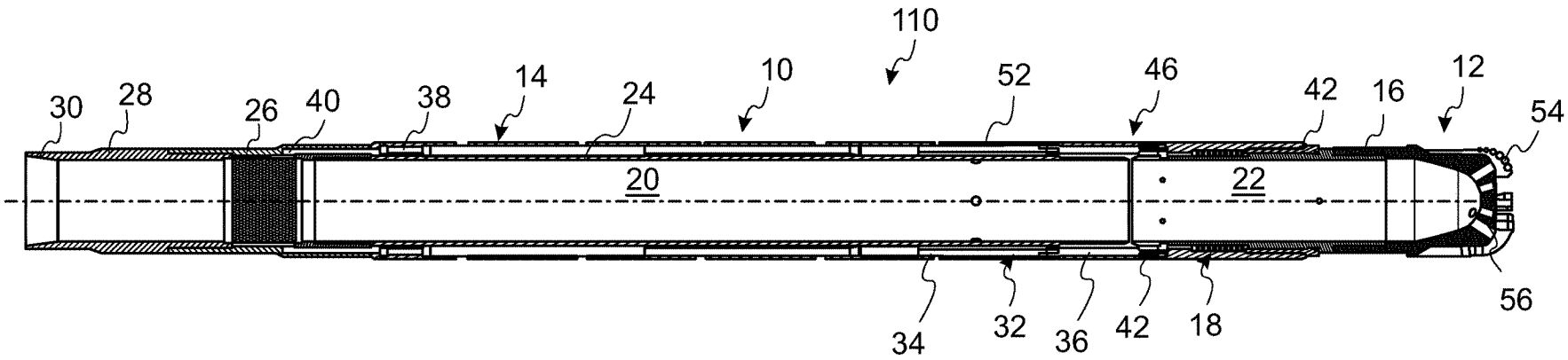
FIG. 4 shows a longitudinal sectional view of the downhole tool shown in FIG. 3.
Figure 5:
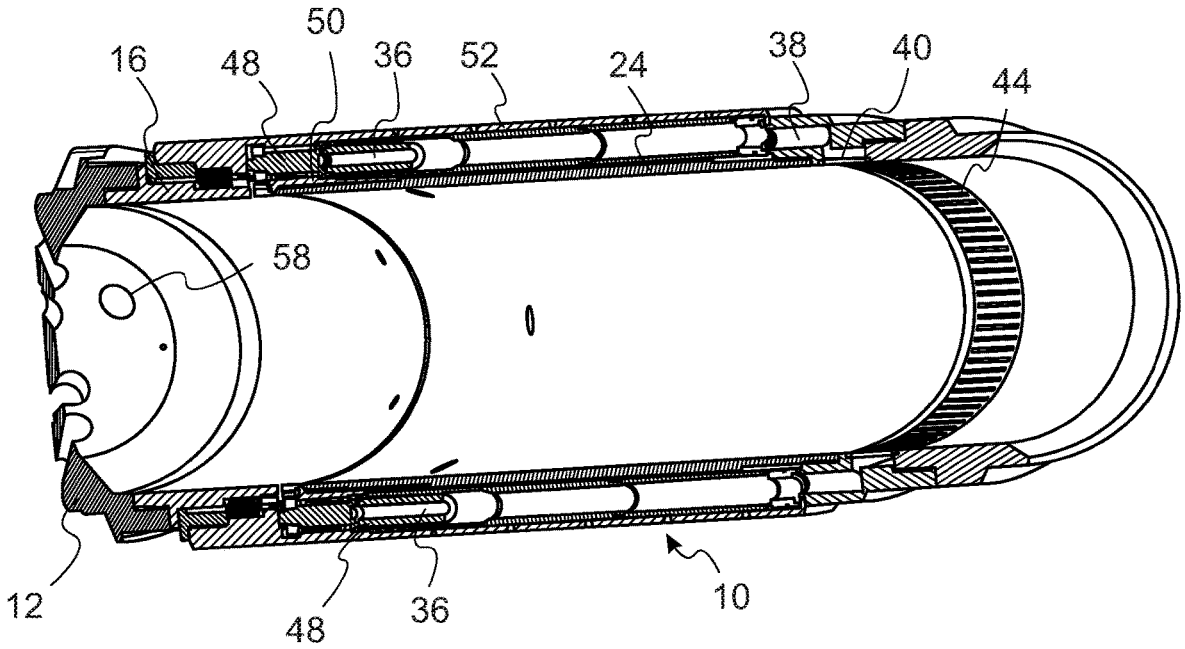
FIGS. 5 and 6 show perspective cut away views of parts of the downhole tool shown in FIG. 4.
Figure 6:
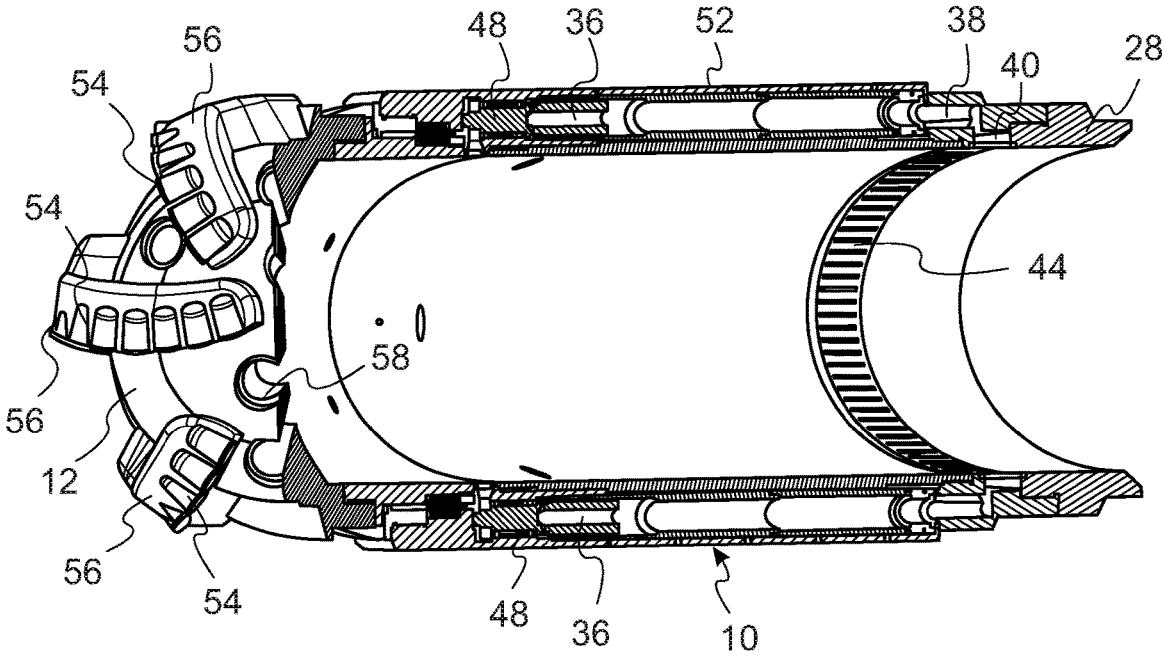

Referring now to FIGS. 3 to 6 of the accompanying drawings, there is shown a downhole tool 110 comprising the rotary drive apparatus 10. FIG. 3 shows a side view of a downhole tool comprising the rotary drive apparatus shown in FIG. 1. FIG. 4 shows a longitudinal sectional view of the downhole tool shown in FIG. 3. FIGS. 5 and 6 show perspective cut away views of parts of the downhole tool shown in FIG. 4.

In the illustrated downhole tool 110, the bit 12 takes the form of a drill bit for drilling the borehole B. However, it will be understood that the bit may alternatively take the form of a reaming bit for reaming a pre-drilled borehole.

As shown, the bit 12 comprises cutters 54 disposed in the lobes 56 of the bit 12. In the illustrated downhole tool 110, the cutters 54 take the form of polycrystalline diamond compact (PDC) cutters. The bit 12 further comprises a number of flow passages 58 which communicate with the throughbores 20, 22. The flow passages 58 may comprise or take the form of nozzles.

Figure 7:
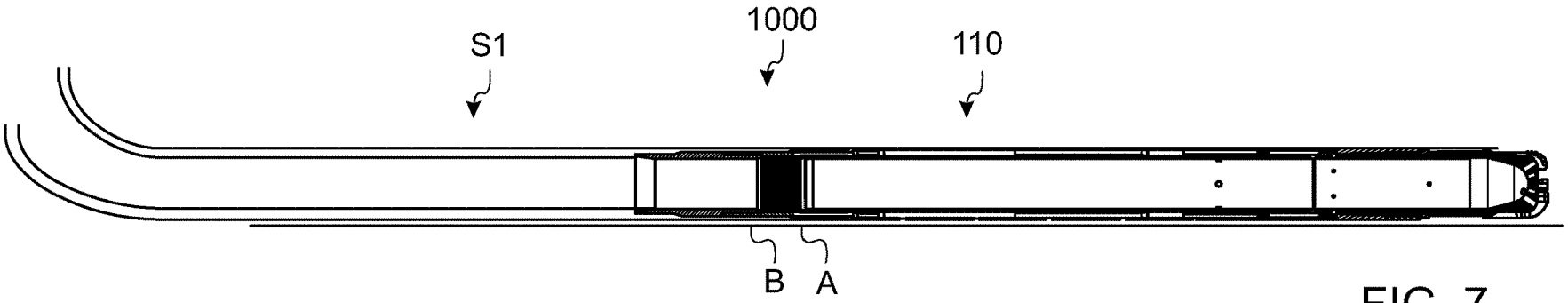
FIG. 7 shows a diagrammatic view of a downhole tool string assembly comprising the downhole tool.

FIG. 7 of the accompanying drawings shows a downhole assembly 1000 including the downhole tool 110. As shown in FIG. 7, the assembly 1000 includes bore-lining tubing string S1, which in the illustrated system 1000 takes the form of a casing string.

Figure 8:
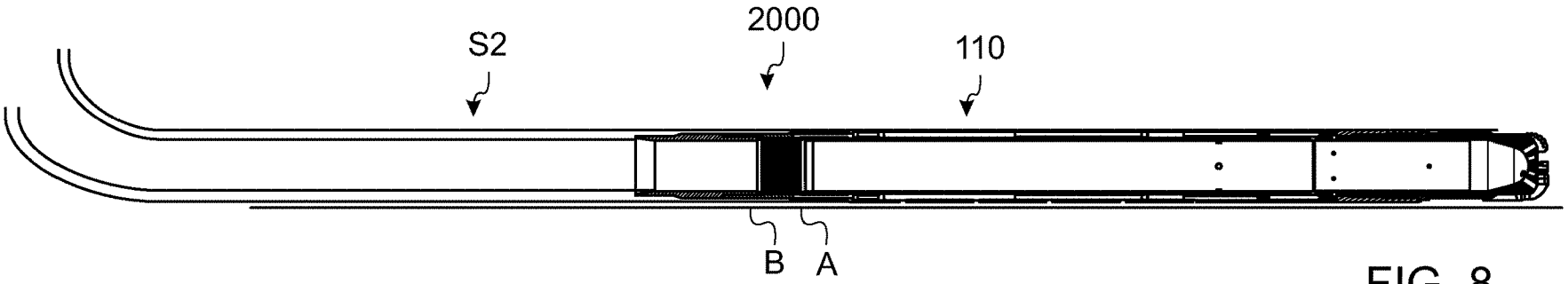
FIG. 8 shows a diagrammatic view of an alternative downhole tool string assembly comprising the downhole tool.

FIG. 8 of the accompanying drawings shows a downhole assembly 2000 including the downhole tool 110. As shown in FIG. 8, the assembly 2000 includes bore-lining tubing string S2, which in the illustrated system 2000 takes the form of a liner string.

Figure 9:
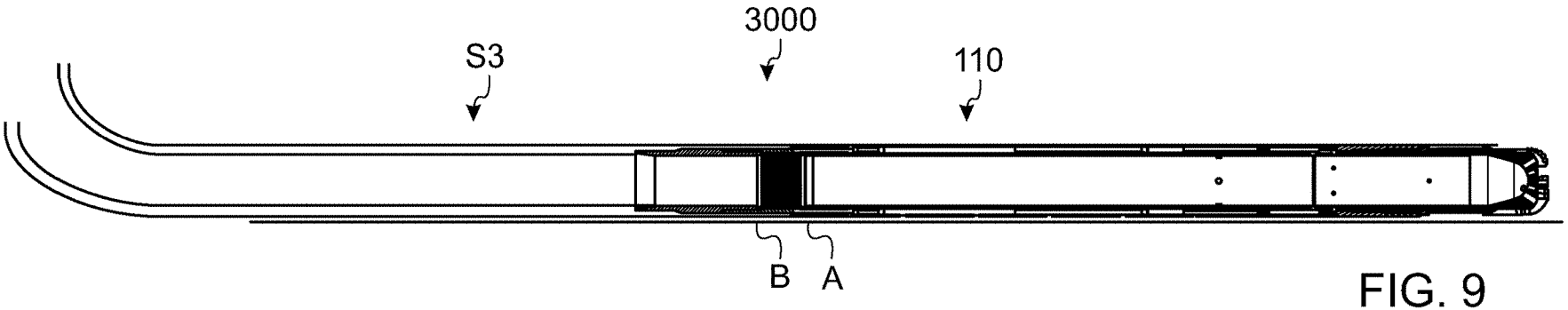
FIG. 9 shows a diagrammatic view of a downhole tool string assembly comprising the downhole tool.

FIG. 9 of the accompanying drawings shows a downhole assembly 3000 including the downhole tool 110. As shown in FIG. 9, the assembly 3000 includes bore-lining tubing string S3, which in the illustrated system 3000 takes the form of a production tubing string.

Various modifications may be made without departing from the scope of the invention as defined in the claims.

The invention claimed is:

1. A downhole rotary drive apparatus for driving a bit used to drill or ream a borehole, the apparatus comprising:

a body configured for coupling to, or forming part of, a tubular string for running into the borehole, wherein the body comprises one or more radially-projecting blade portions;

one or more slots arranged to facilitate evacuation of drilling or reaming debris and/or drive fluid between the one or more radially-projecting blade portions; and a central access passage, through the body, around which the one or more radially-projecting blade portions are circumferentially distributed;

an output shaft at least partially disposed within and rotatably mounted to the body, wherein the output shaft is configured for coupling to the bit such that rotation of the output shaft relative to the body drives rotation of the bit, the output shaft also comprising a central longitudinal access passage;

a plurality of rotary drives disposed around the body, wherein each of the plurality of rotary drives comprises a respective rotor; and a transmission arrangement for converting rotation of the rotors of the rotary drives into rotation of the output shaft, wherein the transmission arrangement comprises a drive component mounted on at least one rotor of the plurality of rotary drives and a driven component mounted on the output shaft, the driven component being disposed radially inwards of the drive component such that an inner radial surface of the drive component engages an outer surface of the driven component so that rotation of the driven component by the drive component drives rotation of the output shaft, wherein at least part of the rotary drives and/or part of the transmission arrangement are disposed within, and are radially positioned within, the blade portions, and wherein the central access passages of the body and the output shaft being sufficiently configured to permit passage of a subsequent drill bit therethrough.

2. The rotary drive apparatus of claim 1, wherein the body forms a stator of the rotary drive apparatus.

3. The rotary drive apparatus of claim 1, wherein the body comprises a section of casing, liner or production tubing.

4. The rotary drive apparatus of claim 1, wherein the output shaft comprises or takes the form of a section of drill pipe.

5. The rotary drive apparatus of claim 1, wherein one or more of the rotary drives comprises or takes the form of a motor.

6. The rotary drive apparatus of claim 1, wherein one or more of the rotary drives is fluid-powered.

7. The rotary drive apparatus of claim 6, wherein one or more of the rotary drives comprises or takes the form of a positive displacement motor.

8. The rotary drive apparatus of claim 1, wherein the rotary drives are circumferentially arranged and/or spaced.

9. The rotary drive apparatus of claim 1, wherein the rotary drives are disposed, positioned and/or sized such that no portion of any of the rotary drives extends across a central longitudinal axis of the apparatus nor into the central longitudinal access passage.

10. The rotary drive apparatus of claim 1, wherein each of the rotary drives comprises a stator.

11. The rotary drive apparatus of claim 10, wherein the stator is integrally formed within the body.

12. The rotary drive apparatus of claim 10, wherein the stator comprises a separate component coupled to the body.

13. The rotary drive apparatus of claim 10, wherein the stator is at least partially constructed from an elastomer.

14. The rotary drive apparatus of claim 1, wherein the transmission arrangement comprises or takes the form of a gear assembly.

15. The rotary drive apparatus of claim 14, wherein the drive component comprises a drive gear disposed or formed on the at least one of the rotors of the rotary drives and the driven component comprises a drive gear disposed or formed on the output shaft.

16. A downhole tool for drilling or reaming a borehole, the downhole tool comprising:

a bit; and an apparatus comprising:

a body configured for coupling to, or forming part of, a tubular string for running into the borehole, wherein the body comprises one or more radially-projecting blade portions;

one or more slots arranged to facilitate evacuation of drilling or reaming debris and/or drive fluid between the one or more radially-projecting blade portions; and a central access passage, through the body, around which the one or more radially-projecting blade portions are circumferentially distributed;

an output shaft at least partially disposed within and rotatably mounted to the body, wherein the output shaft is configured for coupling to the bit such that rotation of the output shaft relative to the body drives rotation of the bit, the output shaft also comprising a central longitudinal access passage;

a plurality of rotary drives disposed around the body, wherein each of the plurality of rotary drives comprises a respective rotor; and a transmission arrangement for converting rotation of the rotors of the rotary drives into rotation of the output shaft, wherein the transmission arrangement comprises a drive component mounted on at least one rotor of the plurality of rotary drives and a driven component mounted on the output shaft, the driven component being disposed radially inwards of the drive component such that an inner radial surface of the drive component engages an outer surface of the driven component so that rotation of the driven component by the drive component drives rotation of the output shaft, wherein at least part of the rotary drives and/or part of the transmission arrangement are disposed within, and are radially positioned within, the blade portions, and wherein the central access passages of the body and the output shaft being sufficiently configured to permit passage of a subsequent drill bit therethrough.

17. The downhole tool of claim 16, wherein the bit takes the form of a drill bit.

18. The downhole tool of claim 16, wherein the bit takes the form of a reaming bit.

19. A downhole assembly comprising:

a downhole tool comprising:

a bit;

a tubular string;

a body configured for coupling to, or forming part of, the tubular string for running into a borehole, wherein the body comprises one or more radially-projecting blade portions;

one or more slots arranged to facilitate evacuation of drilling or reaming debris and/or drive fluid between the one or more radially-projecting blade portions; and a central access passage, through the body, around which the one or more radially-projecting blade portions are circumferentially distributed;

an output shaft at least partially disposed within and rotatably mounted to the body, wherein the output shaft is configured for coupling to the bit such that rotation of the output shaft relative to the body drives rotation of the bit, the output shaft also comprising a central longitudinal access passage;

a plurality of rotary drives disposed around the body, wherein each of the plurality of rotary drives comprises a respective rotor; and a transmission arrangement for converting rotation of the rotors of the rotary drives into rotation of the output shaft, wherein the transmission arrangement comprises a drive component mounted on at least one rotor of the plurality of rotary drives and a driven component mounted on the output shaft, the driven component being disposed radially inwards of the drive component such that an inner radial surface of the drive component engages an outer surface of the driven component so that rotation of the driven component by the drive component drives rotation of the output shaft, wherein at least part of the rotary drives and/or part of the transmission arrangement are disposed within, and are radially positioned within, the blade portions, and wherein the central access passages of the body and the output shaft being sufficiently configured to permit passage of a subsequent drill bit therethrough.

20. The downhole assembly of claim 19, wherein the tubular string comprises or takes the form of: a bore-lining tubular string, such as a casing string or a liner string; or a production tubing string.

21. A method for drilling a borehole; comprising:

using a downhole tool comprising:

a bit; and an apparatus comprising:

a body configured for coupling to, or forming part of, a tubular string for running into the borehole, wherein the body comprises one or more radially-projecting blade portions;

one or more slots arranged to facilitate evacuation of drilling or reaming debris and/or drive fluid between the one or more radially-projecting blade portions; and a central access passage, through the body, around which the one or more radially-projecting blade portions are circumferentially distributed;

an output shaft at least partially disposed within and rotatably mounted to the body, wherein the output shaft is configured for coupling to the bit such that rotation of the output shaft relative to the body drives rotation of the bit, the output shaft also comprising a central longitudinal access passage;

a plurality of rotary drives disposed around the body, wherein each of the plurality of rotary drives comprises a respective rotor; and a transmission arrangement for converting rotation of the rotors of the rotary drives into rotation of the output shaft, wherein the transmission arrangement comprises a drive component mounted on at least one rotor of the plurality of rotary drives and a driven component mounted on the output shaft, the driven component being disposed radially inwards of the drive component such that an inner radial surface of the drive component engages an outer surface of the driven component so that rotation of the driven component by the drive component drives rotation of the output shaft, wherein at least part of the rotary drives and/or part of the transmission arrangement are disposed within, and are radially positioned within, the blade portions, and wherein the central access passages of the body and the output shaft being sufficiently configured to permit passage of a subsequent drill bit therethrough.

22. The method of claim 21, comprising the steps of:

locating the bit on the apparatus; and/or locating the apparatus on the tubular string.

23. The method of claim 21, comprising the steps of:

running the downhole tool into the borehole on the tubular string; and/or directing drive fluid to and/or through the apparatus.

* * * * *